US011406195B2

(12) United States Patent
Kester

(10) Patent No.: US 11,406,195 B2
(45) Date of Patent: Aug. 9, 2022

(54) BACK SUPPORT

(71) Applicant: Alida Lucille Kester, Charlotte, NC (US)

(72) Inventor: Alida Lucille Kester, Charlotte, NC (US)

( * ) Notice: Subject to any disclaimer, the term of this patent is extended or adjusted under 35 U.S.C. 154(b) by 726 days.

(21) Appl. No.: 16/402,752

(22) Filed: May 3, 2019

(65) Prior Publication Data

US 2020/0345147 A1 Nov. 5, 2020

(51) Int. Cl.
*A47C 16/00* (2006.01)
*A47B 39/08* (2006.01)

(52) U.S. Cl.
CPC ..... *A47C 16/005* (2013.01); *A47B 39/08* (2013.01)

(58) Field of Classification Search
CPC ..... A47C 7/425; A47C 7/46; A47C 20/027; A47C 7/40; A47C 31/126; A61H 1/0292
USPC ..... 297/284.5, 452.32, 452.31
See application file for complete search history.

(56) References Cited

U.S. PATENT DOCUMENTS

| | | | | |
|---|---|---|---|---|
| 3,078,484 | A * | 2/1963 | Briggs | A47K 7/043 4/606 |
| 4,431,232 | A * | 2/1984 | Hannouche | A47C 7/425 297/452.32 |
| 6,589,143 | B2 * | 7/2003 | Taylor | A61H 7/001 297/284.3 |
| 9,254,042 | B2 * | 2/2016 | Halliday | A47C 7/462 |
| 9,919,183 | B1 * | 3/2018 | Moschel | A63B 23/1245 |
| 9,999,304 | B2 * | 6/2018 | Krishtul | A47C 7/46 |
| 2017/0360204 | A1 * | 12/2017 | Ellis | A47C 7/425 |

* cited by examiner

*Primary Examiner* — Sarah B McPartlin
(74) *Attorney, Agent, or Firm* — Shumaker, Loop & Kendrick, LLP

(57) ABSTRACT

A back support that includes a base for being mounted on a vertical structure and a plurality of projections extending outwardly from a front side of the base, laterally along a width of the base and vertically long a length of the base. An outermost extent of the projections collectively defines a vertically-oriented curvature generally corresponding to a human spinal curvature and against which an individual can engage the back for support while standing.

16 Claims, 4 Drawing Sheets

BACK SUPPORT

TECHNICAL FIELD AND BACKGROUND OF INVENTION

This invention relates to a back support adapted to provide support to the spine and associated muscles and bones of an individual while standing. It has been observed that many students stand in the back of crowded lecture halls, many times standing with the back against a wall. While some individuals may have no option but to stand due to lack of seating in overcrowded classes, others prefer to stand, perhaps to ease pre-existing back problems or to provide a break from a conventional seated position. Without regard to why students stand in class, doing so can result in back pain, discomfort, and a general lack of focus on the material being presented. The device described and claimed in this application provides a means of supporting the back, encouraging proper posture and enabling better physical and mental engagement.

The human back is the large posterior area of the human body, rising from the top of the buttocks to the back of the neck and the shoulders. It is the surface of the body opposite from the chest. The vertebral column runs the length of the back and creates a central area of recession. The breadth of the back is created by the shoulders at the top and the pelvis at the bottom. The human back is composed of a complex structure of muscles, ligaments, tendons, disks, and bones, which work together to support the body and enable the body to move as commanded by the central nervous system.

The central feature of the human back is the vertebral column, specifically the length from the top of the thoracic vertebrae to the bottom of the lumbar vertebrae, which houses the spinal cord in its spinal canal, and which generally has some curvature that gives shape to the back. The ribcage extends from the spine at the top of the back (with the top of the ribcage corresponding to the T1 vertebra), more than halfway down the length of the back, leaving an area with less protection between the bottom of the ribcage and the hips. The width of the back at the top is defined by the scapula, the broad, flat bones of the shoulders.

Back pain is the second most common type of pain in adults (the most common being headaches). By far the most common cause of back pain is muscle strain. The back muscles can usually heal themselves within a couple of weeks, but the pain can be intense and debilitating. Other common sources of back pain include disc problems, such as degenerative disc disease or a lumbar disc herniation, many types of fractures, scoliosis, spondylolisthesis, an osteoporotic fracture, or osteoarthritis.

In many cases back pain can be reduced or prevented by standing. However, standing, particularly standing motionless for an extended time, can cause back pain due to the inability of the muscles and related structures to flex and move. Therefore, the device described and claimed in this application provides support to the back of an individual standing relatively still for an extended period of time. While the device is described with reference to a scholastic environment, the device has application in any environment where standing relatively motionless for extended periods of time is necessary or desirable.

SUMMARY OF THE INVENTION

It is therefore an object of the present invention to provide a back support for an individual standing motionless.

It is another object of the invention to provide a back support that is easily adjustable to accommodate individuals of differing height.

It is another object of the invention to provide a back support that is easily fabricated. It is another object of the invention to provide a back support that permits the standing individual to provide stimulation to the back while otherwise motionless.

These and other objects and advantages of the invention are achieved by providing a back support that includes a base for being mounted on a vertical surface and having a plurality of laterally-extending projections extending outwardly from the base. The outermost extent of the projections collectively defines a vertically-oriented curvature generally corresponding to the human spinal curvature and against which an individual can engage the back for support while standing.

According to one aspect of the invention, a bracket is carried by a rear side of the base for cooperating with a complementary fastening element positioned on the vertical structure for mounting the back support at a predetermined position.

According to another aspect of the invention, the vertically-oriented curvature defined by the projections is symmetrical top to bottom.

According to another aspect of the invention, each projection is positioned in a respective laterally-extending mortice in the front side of the base.

According to another aspect of the invention, the fastening element comprises a plurality of vertically spaced-apart hooks adapted for being mounted on the vertical structure.

According to another aspect of the invention, a spacer is positioned on the back side of the base proximate the bottom edge to rest against the vertical structure and stabilize base.

According to another aspect of the invention, the length of the base is 1.3 times the width of the base.

According to another aspect of the invention, the length of the base is 16 in. (40 cm) and the width of the base is 12 in. (30 cm).

According to another aspect of the invention, each projection is 0.25 in. (6.4 mm) thick and is spaced-apart by 0.375 in. (9.5 mm).

According to another aspect of the invention, the topmost and the bottommost projections each extend outwardly from the base 0.375 in. (9.5 mm), and the middle projection extends outwardly from the base 1.4 in. (35.6 mm).

According to another aspect of the invention, a back support is provided that includes a base having a length that is 1.3 times a width for being mounted on a vertical structure. A bracket is carried by a rear side of the base for cooperating with complementary fastening elements positioned on the vertical structure for mounting the back support at a predetermined position, the fastening elements comprising a plurality of vertically spaced-apart hook pairs laterally spaced-apart and adapted for being mounted on the vertical structure. A plurality of vertically spaced-apart, laterally-extending mortices is formed in the front side of the base. A plurality of projections are positioned in the respective mortices and extend outwardly from the front side of the base, laterally along a width of the base and vertically long a length of the base. An outermost extent of the projections collectively defines a vertically-oriented curvature symmetrical top to bottom generally corresponding to a human spinal curvature and against which an individual can engage the back for support while standing.

DETAILED DESCRIPTION OF THE PREFERRED EMBODIMENT

Figure 1:
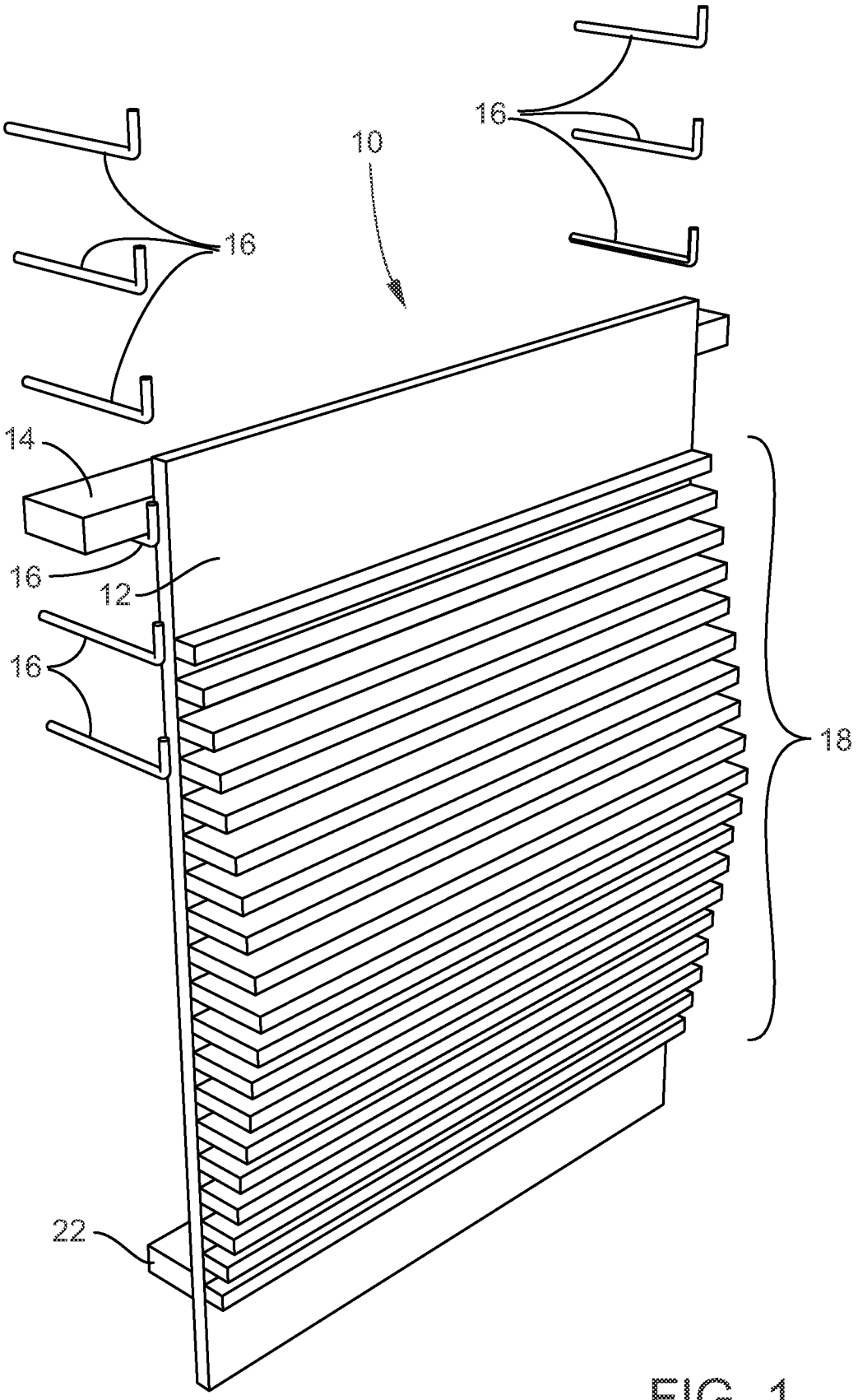
FIG. 1 is a front perspective view of a back support according to one preferred embodiment of the invention.
Figure 2:
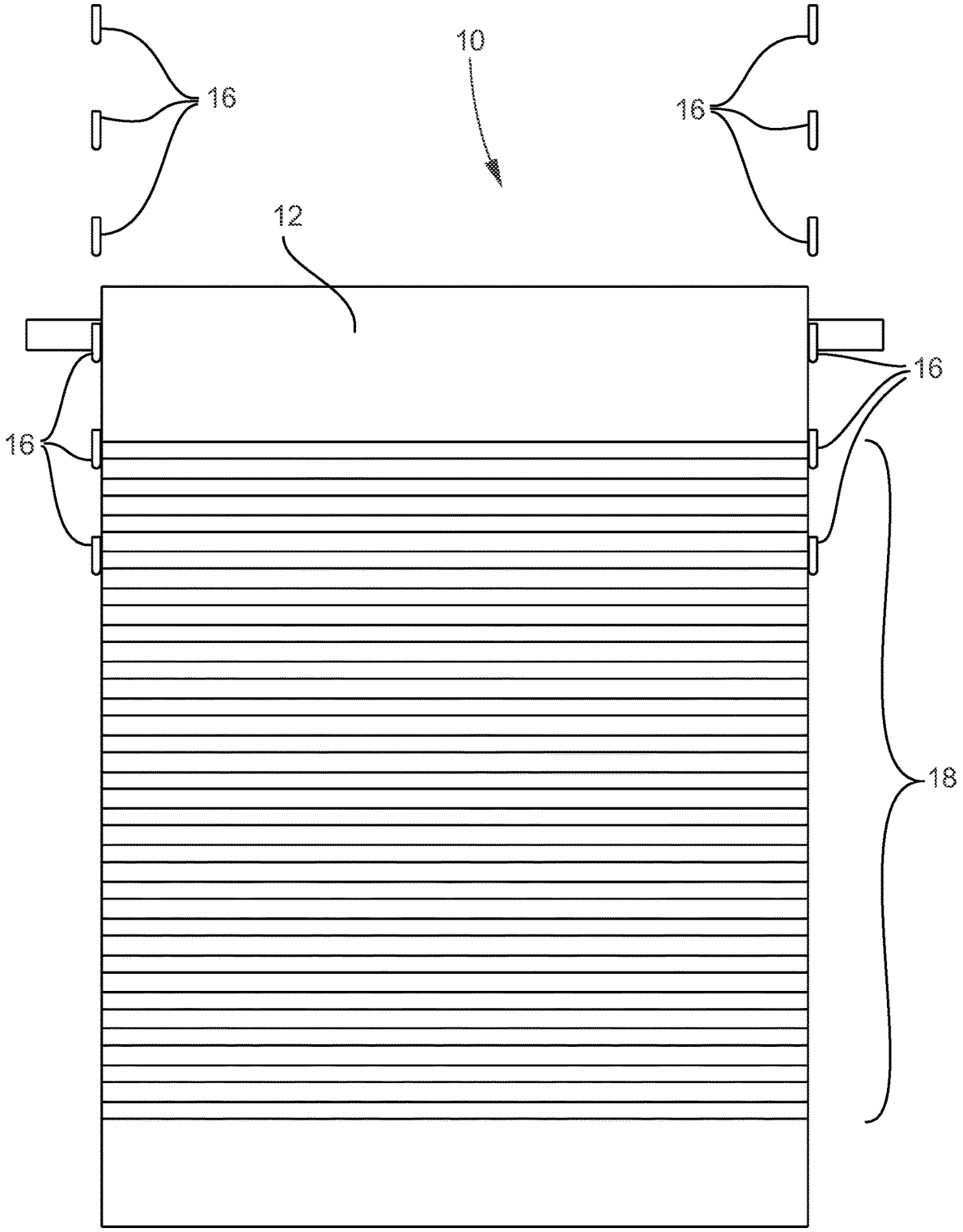
FIG. 2 is a front elevation of the back support according to FIG. 1.
Figure 3:
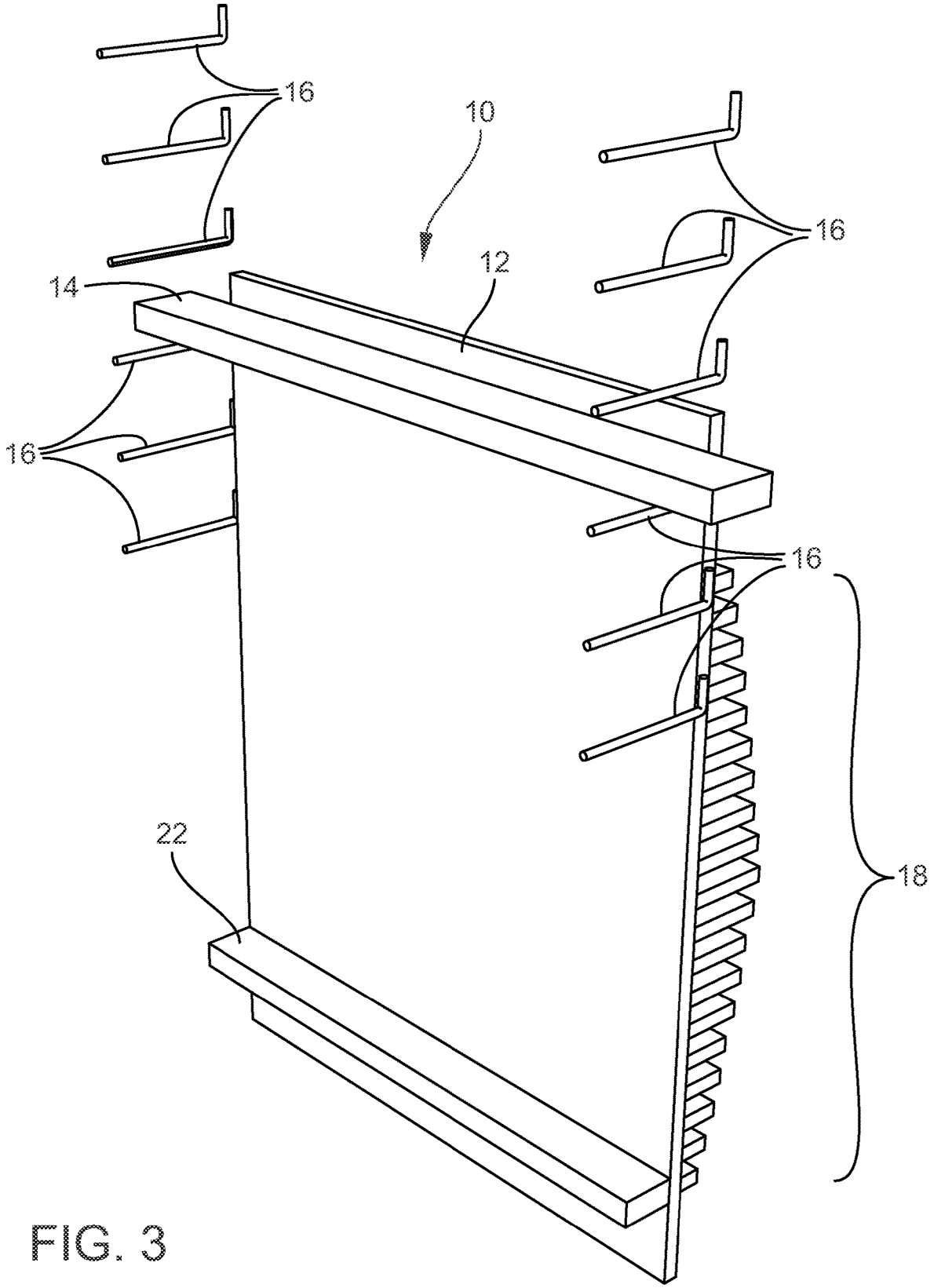
FIG. 3 is a rear perspective view of the back support according to FIG. 1.

Referring now to FIGS. 1-4 of the drawings, a back support according to a preferred embodiment of the invention is shown and indicated broadly by reference numeral 10. The back support 10 has a base 12 for being mounted on a vertical surface such as a wall. A bracket 14 mounted to the rear side of the base 12 permits the back support 10 to be positioned on the wall at a preferred height based on vertical spacing between a series of vertical pairs of mounting hooks 16. Other means for mounting the back support 10 may be used, including hook and eye assemblies, touch fasteners, venetian blind-type cords, suction cups, or the back support 10 may be mounted in a fixed position.

In one preferred embodiment of the back support 10, a plurality of outwardly and laterally-extending projections 18 are positioned in vertically spaced-part intervals along a length of the base 12. The outermost extent of the projections 18 collectively defines a vertically-oriented curvature generally corresponding to the human spinal curvature and against which an individual can engage the back for providing support while standing. See FIG. 4. The projections 18 are preferably mounted in shallow mortices 20 that extend laterally across the base 12 and into which the projections 18 are positioned and then secured in place by, for example, a suitable glue, adhesive or mechanical fasteners. The front edge surface of the projections 18 may either be individually vertical or may be angled slightly to correspond to the angle of curvature at the location of that projection. A spacer 22 is fastened to the back side of the base 12 near the bottom and adapted to position the bottom of the base 12 away from the wall to provide stability to the base 12.

The above-described structure permits an individual to adjust the back support 10 to a desired height position and then stand against the projections 18, perhaps with a slight rearward lean, to obtain support for the back muscles and spine. The spacing of the projections 18 provides support while stimulating the back muscles. Slight up and down movement may provide a moderate massaging effect that further relaxes the back muscles, permitting the individual to stand for a longer period of time without back pain or fatigue.

By way of illustration, in a preferred embodiment of the back support 10 is fabricated of wood, for example, birch. The projections 18 are 0.25 in. (6.4 mm) thick and the spacing between each projection 18 is 0.375 in. (9.5 mm). The shortest projections 18, the topmost and bottommost, extend outwardly from the base 12 by 0.375 in. (9.5 mm) and progressively lengthen, increasing by 0.125 in. (3.18 mm) per projection 18 toward the middle, where the middle projection 18 extends outwardly 1.4 in (35.6 mm). In this particular embodiment there are 19 projections. The base 12 is preferably 12 in. (30 cm) wide and 16 in. (40 cm) long.

The distance from the top side of the topmost projection 18 to the bottom side of the bottommost projection 18 is 11.5 in. (29 cm). (18 vertical spaces at 0.375 in. (9.5 mm)/space and 19 projections at 0.25 in. (6.4 mm)/proj).)

The manner and details of the construction are not critical. For example, the base and projections can be molded, machined or otherwise formed as a single, integral structure, or the projections can be molded as a single, integral structure and then mounted on a base. The projections need not be continuous from side-to-side of the base, but may be spaced-part in both the vertical and lateral directions.

Figure 4:
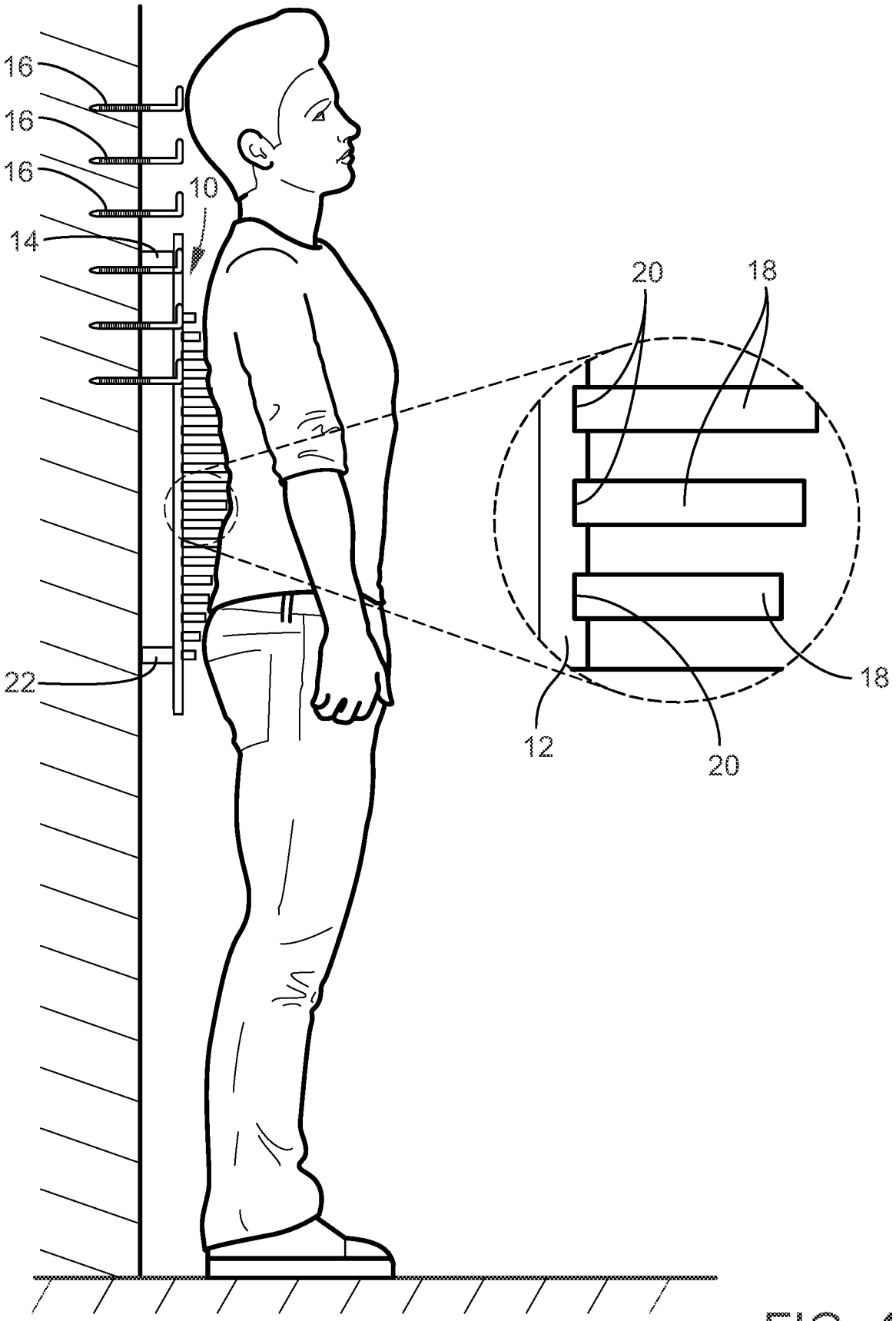
FIG. 4 is a side environmental elevation showing conformance of the back support relative to the human back.

Referring to FIG. 4, the top edge of the base 12 resides at approximately T2-T3, the topmost projection 18 at approximately T5-T6, the bottommost projection 18 resides at approximately L4-L5, and the bottom of the base 12 resides at approximately S3-S4.

A back support according to the invention has been described with reference to specific embodiments and examples. Various details of the invention maybe changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A back support, comprising:

(a) a base for being mounted on a vertical structure;

(b) a plurality of projections extending outwardly from a front side of the base, laterally along a width of the base and vertically along a length of the base;

(c) an outermost extent of the projections collectively defining a vertically-oriented curvature generally corresponding to a human spinal curvature and against which an individual can engage the back for support while standing;

wherein each projection is positioned in a respective laterally-extending mortice in a front side of the base.

2. A back support according to claim 1, and including a bracket carried by a rear side of the base for cooperating with a complementary fastening element positioned on the vertical structure for mounting the back support at a predetermined vertical position.

3. A back support according to claim 1, wherein the vertically-oriented curvature defined by the projections is symmetrical top to bottom.

4. A back support according to claim 2, wherein the complementary fastening element comprises a plurality of vertically spaced-apart hooks adapted for being mounted on the vertical structure.

5. A back support according to claim 1, and including a spacer positioned on a back side of the base proximate the bottom edge and adapted to rest against the vertical structure and stabilize the base.

6. A back support according to claim 1, wherein a length of the base is 1.3 times a width of the base.

7. A back support according to claim 1, wherein a length of the base is 16 in. (40 cm) and a width of the base is 12 in. (30 cm).

8. A back support according to claim 7, wherein each projection is 0.25 in. (6.4 mm) thick and is spaced-apart from adjacent projections by 0.375 in. (9.5 mm).

9. A back support according to claim 1, wherein a topmost and a bottommost projection each extend outwardly from the base 0.375 in. (9.5 mm), and a middle projection extends outwardly from the base 1.4 in. (35.6 mm).

10. A back support, comprising:

(a) a base having a length that is 1.3 times a width for being mounted on a vertical structure;

(b) a bracket carried by a rear side of the base for cooperating with a complementary fastening element positioned on the vertical structure for mounting the back support at a predetermined position, the fastening element comprising a plurality of vertically spaced-apart hooks adapted for being mounted on the vertical structure;

(c) a plurality of vertically spaced-apart, laterally-extending mortices in a front side of the base;

(d) a plurality of projections positioned in respective mortices and extending outwardly from the front side of the base, laterally along a width of the base and vertically long a length of the base; and (e) an outermost front edge surface of the projections collectively defining a vertically-oriented curvature symmetrical top to bottom, generally corresponding to a human spinal curvature and against which an individual can engage the back for support while standing.

11. A back support according to claim 10, wherein the fastening element comprises a plurality of vertically spaced-apart hooks adapted for being mounted on the vertical structure.

12. A back support according to claim 10, and including a spacer positioned on a back side of the base proximate a bottom edge and adapted to rest against the vertical structure and stabilize the base.

13. A back support according to claim 10, wherein a length of the base is 1.3 times a width of the base.

14. A back support according to claim 10, wherein a length of the base is 16 in. (40 cm) and a width of the base is 12 in. (30 cm).

15. A back support according to claim 14, wherein each projection is 0.25 in. (6.4 mm) thick and is spaced-apart by 0.375 in. (9.5 mm).

16. A back support according to claim 15, wherein a topmost and a bottommost projection each extend outwardly from the base 0.375 in. (9.5 mm), and a middle projection extends outwardly from the base 1.4 in. (35.6 mm).

* * * * *